US008622148B2

(12) United States Patent
Eisenhardt

(10) Patent No.: US 8,622,148 B2
(45) Date of Patent: Jan. 7, 2014

(54) POWER TOOL

(75) Inventor: Armin Eisenhardt, Bisingen (DE)

(73) Assignee: AEG Electric Tools GmbH, Winnenden (DE)

( * ) Notice: Subject to any disclaimer, the term of this patent is extended or adjusted under 35 U.S.C. 154(b) by 329 days.

(21) Appl. No.: 13/009,176

(22) Filed: Jan. 19, 2011

(65) Prior Publication Data

US 2011/0174510 A1 Jul. 21, 2011

(30) Foreign Application Priority Data

Jan. 20, 2010 (DE) ..... 10 2010 004 961

(51) Int. Cl.
*E02D 7/06* (2006.01)

(52) U.S. Cl.
USPC ..... 173/48; 173/104

(58) Field of Classification Search
USPC ..... 173/48, 104, 109, 216, 217
See application file for complete search history.

(56) References Cited

U.S. PATENT DOCUMENTS

| | | | | |
|---|---|---|---|---|
| 6,557,648 | B2 * | 5/2003 | Ichijyou et al. | 173/48 |
| 7,306,049 | B2 * | 12/2007 | Soika et al. | 173/49 |
| 2005/0269116 | A1 * | 12/2005 | Frauhammer et al. | 173/48 |
| 2006/0137888 | A1 | 6/2006 | Soika et al. | |
| 2007/0125563 | A1 * | 6/2007 | Furusawa et al. | 173/48 |

FOREIGN PATENT DOCUMENTS

| | | | |
|---|---|---|---|
| DE | 3319934 | A1 | 12/1983 |
| DE | 19716976 | A1 | 10/1998 |
| DE | 10115119 | A1 | 10/2002 |
| DE | 10261030 | | 7/2004 |
| DE | 102004046627 | | 3/2006 |
| DE | 102004055236 | A1 | 5/2006 |
| DE | 102006035417 | A1 | 5/2008 |
| EP | 1674207 | A1 | 6/2006 |
| EP | 1950009 | A1 | 7/2008 |
| JP | H6-57567 | | 8/1994 |
| WO | 2004/060616 | A1 | 7/2004 |
| WO | 2009/083307 | A1 | 7/2009 |

OTHER PUBLICATIONS

European Search Report dated Apr. 29, 2011.

* cited by examiner

*Primary Examiner* — Alexandra Elve
*Assistant Examiner* — Nathaniel Chukwurah
(74) *Attorney, Agent, or Firm* — Carlson, Gaskey & Olds, P.C.

(57) ABSTRACT

A hand-operated power tool, particularly a hammer drill (1), includes a drive motor (2), a tool spindle (3) to drive a tool in rotary manner, a rotary drive transmission (4) to couple the drive motor (2) to the tool spindle (3), a hammer mechanism (5) to drive the tool in percussive manner, a hammer mechanism transmission (6) to couple the drive motor (2) to the hammer mechanism (5), and a switching device (7) to activate and deactivate the hammer mechanism (5). The switching device (7) has a clutch (9) that is integrated in a force path (10) of the hammer mechanism transmission (6) and has an actuation stroke (11) for advancing and withdrawing the clutch (6), which stroke extends perpendicularly to the axis of rotation (8) of the tool spindle (3), or parallel to an axis of rotation (37) of an actuating element (28) that is rotated manually to actuate the switching device (7) for advancing and withdrawing the clutch (6).

11 Claims, 5 Drawing Sheets

POWER TOOL

REFERENCE TO RELATED APPLICATION

This application claims priority to German Application No. 10 2010 004 961.1-15 filed on Jan. 20, 2010.

BACKGROUND

The present disclosure relates to a power tool, particularly a power tool that is operated by hand, preferably a hammer drill.

A power tool such as a hammer drill usually includes a drive motor, a tool spindle to drive a tool in rotary manner, a rotary drive transmission to couple the drive motor to the tool spindle, a hammer mechanism to drive the tool in percussive manner, a hammer mechanism transmission to couple the drive motor to the hammer mechanism, and a switching device to activate and deactivate the hammer mechanism.

SUMMARY

The disclosed power tool includes a switching device with a clutch that is integrated in the force path of the hammer mechanism transmission and has an actuation stroke for advancing and withdrawing, that is to say activating an deactivating, the hammer mechanism. The switching device is also designed so that a stroke direction of this actuation stroke extends perpendicularly to the axis of rotation of the tool spindle, or parallel to an axis of rotation of an element that is rotated manually to actuate the switching device. The actuation stroke may also extend perpendicularly to the axis of rotation of the tool spindle and parallel to the axis of rotation of the actuating element at the same time. In this case, the actuation stroke of the clutch corresponds to a linear displacement movement of a corresponding coupling member that causes the clutch to be advanced and withdrawn. Due to the orientation of the actuation stroke perpendicularly to the axis of rotation of the tool spindle and/or parallel to the axis of rotation of the actuating element as well as the integration of the clutch in the hammer mechanism transmission, the switching device is able to be located close to the tool spindle, thus enabling a construction of the power tool that is more compact overall.

According to one advantageous embodiment, the clutch may be integrated in the force path of the hammer mechanism transmission particularly easily if the hammer mechanism transmission is furnished on the input side with a driving gearwheel that is rotatable about an axis of rotation, and if the hammer mechanism transmission is furnished on the output side with a crank drive wheel that is supported so as to be rotatable about the axis of rotation of the driving gearwheel and which drives a connecting rod of the hammer mechanism when the hammer mechanism is activated. Inside the hammer mechanism transmission, the clutch includes a clutch ring arranged coaxially with the axis of rotation of the driving gearwheel, and on the crank drive wheel so as to be non-rotatable but axially displaceable on the crank drive wheel. Then, this clutch ring cooperates with the driving gearwheel to advance and withdraw the clutch in such manner that when the clutch ring is in the advanced state it transmits a torque from the driving gearwheel to the crank drive wheel, and when it is in the withdrawn state torque is not transmitted from the driving gearwheel to the crank drive wheel. The construction described here enables the clutch to be integrated in the hammer mechanism transmission in particularly compact manner.

According to a practical refinement of this arrangement, the driving gearwheel may include a slaving contour on the axial side facing the crank drive wheel, while a slaving contour corresponding to the slaving contour of the driving gearwheel is provided on the axial side of the clutch ring facing the driving gearwheel, and when the clutch ring is advanced this contour cooperates with the slaving contour on the driving gearwheel to transmit a torque, and when the clutch ring is withdrawn the slaving contour is axially separated therefrom. The axial slaving contours are capable of transmitting large torques and require only a small installation space.

A further refinement is then particularly practical, according to which the switching device has an actuating device for advancing and withdrawing the clutch, and which couples a manually operable actuating element with a displaceable coupling member of the clutch. It is expedient if the coupling member is the clutch ring. The actuating element, which is preferably arranged on the outside of a housing of the power tool, enables engagement with the hammer mechanism transmission, and thus with the clutch, so that it may be advanced and withdrawn.

The actuating device may preferably be equipped with a stroke element that is coupled to the clutch ring via at least one arm section extending parallel to the axis of rotation of the driving gearwheel, so that a stroke displacement of the stroke element away from and parallel to the axis of rotation of the driving gearwheel entrains the clutch ring, thereby extending it. In this way, the actuating device spans across crank drive wheel with the respective arm section of the stroke element to engage with the clutch ring. This enables the actuating device to be disposed coaxially with the axis of rotation of the driving gearwheel for a particularly economical arrangement in terms of space.

According to a further advantageous embodiment, in order to create a rotationally immovable and axially displaceable coupling between the clutch ring and the crank drive wheel, an axial section of the crank drive wheel may be equipped with an exterior slaving contour while the clutch ring is furnished with an interior slaving contour mating therewith, so that the clutch ring is arranged on the crank drive wheel via these slaving contours in non-rotating but axially displaceable manner with respect to the crank drive wheel. In this case, a particularly practical refinement may be realised if the slaving contours have polygonal profiles. These enable transmission of particularly large torques while causing low wear. The suggested design enables particularly compact construction with high functional reliability.

Further important features and advantages of the inventions are explained in the subordinate claims, the drawing, and the associated description of the figures with reference to the drawing.

Of course, the features described in the preceding and those that will be explained in the remainder of this document may be implemented not only in the combination cited in each case, but also in other combinations or alone without exceeding the scope of the present invention.

BRIEF DESCRIPTION OF THE DRAWINGS

Preferred embodiments of the invention are illustrated in the figures and will be explained in greater detail in the following description, in which the same reference numbers are used to refer to identical, or similar, or functionally equivalent components.

In the drawing, all figures of which are schematic in nature.

DETAILED DESCRIPTION

Figure 1:
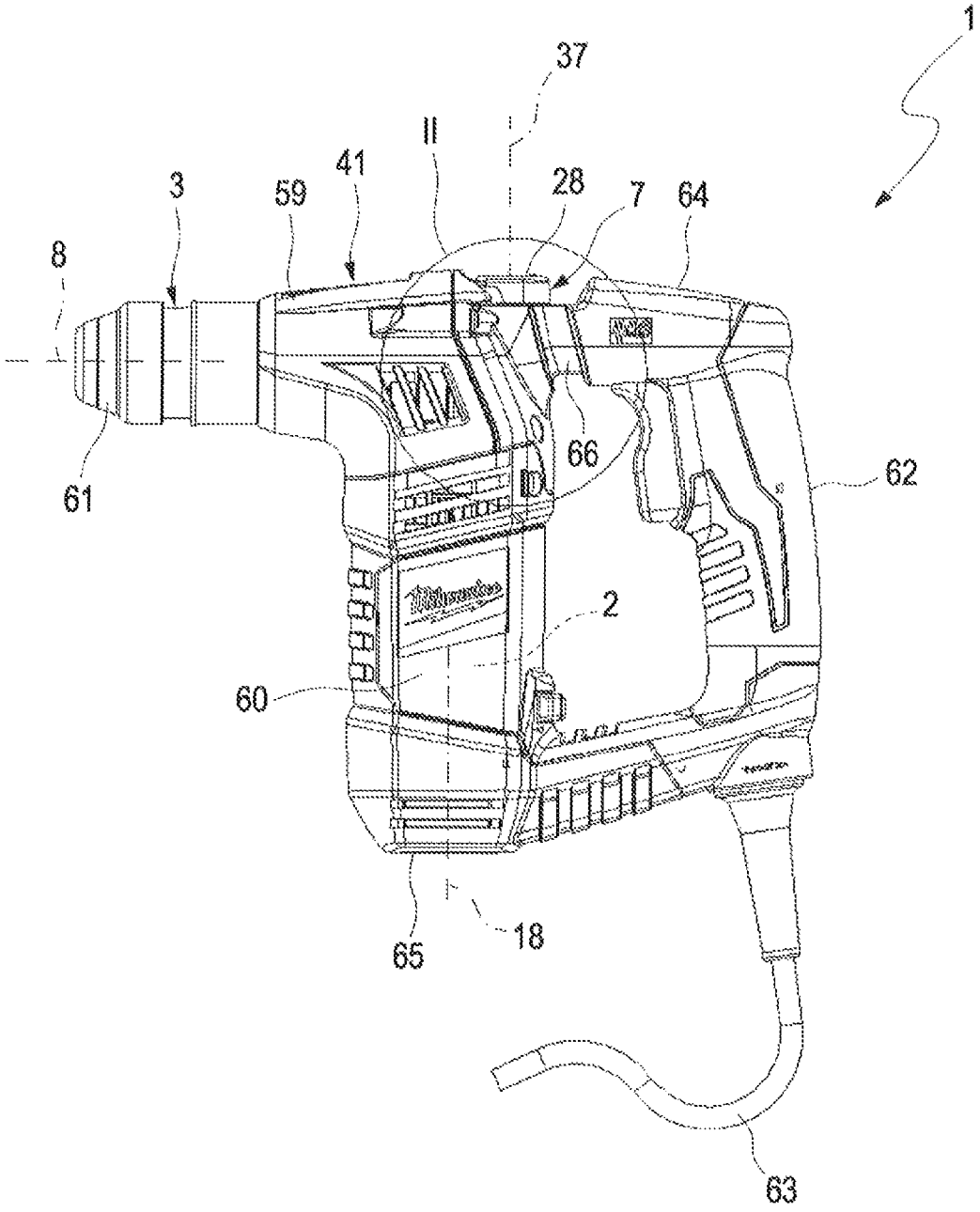
FIG. 1 is a side view of a hammer drill in the form of a power tool.

As shown in FIG. 1, a power tool 1 that is operable by hand, and which is represented as a hammer drill in the example, includes a housing 41 having for example an L-shape, since a spindle section 59 of housing 41 and a motor section 60 of housing 41 are offset relative to one another by about 90°. A tool spindle 3 extends inside spindle section 59, and the end of this spindle that protrudes from housing 41 supports a tool chuck 61. A drive motor 2 is accommodated inside motor sections 60. The lengthwise direction of spindle section 59 is defined by the axis of rotation 8 of tool spindle 3 and it extends parallel therewith. The lengthwise direction of motor section 60 is defined by the axis of rotation 18 of a drive shaft of drive motor 2 and it extends parallel therewith.

Housing 41 has a handle section 62 that extends parallel to motor housing 60 and which in the example is attached at the two opposite ends thereof, to spindle section 59 at one end and to motor section 60 at the other. Hammer drill 1 or the power tool may be connected to an external power supply via a cable 63 in handle section 62. In an alternative embodiment, hammer drill 1 may also be equipped with a rechargeable battery, so that it may be operated without connection to an electricity network.

FIG. 1 shows hammer drill 1 in a typical upright or vertical working position, in which spindle section 59 is orientated horizontally while motor section 60 is orientated vertically. Accordingly, an upper side 64 and a lower side 65 are defined for hammer drill 1 and its housing 41. An actuating element 28 of a switching device 7 is arranged on an area of housing 41 marked with II on upper side 64 thereof. This area II is located vertically above motor section 60, particularly in the area of a connecting point 66 between handle section 62 and spindle section 59. Switching device 7 services to activate and deactivate a hammer mechanism or hammer action of hammer drill 1. When the hammer action is deactivated, hammer drill 1 may be used as a simple drill. Switching device 7 includes an actuating element 28 that is operable manually to engage or disengage the hammer mechanism. For this purpose, actuating element 28 is arranged so as to be rotatable about an axis of rotation 37. In the example, axis of rotation 37 extends parallel to the axis of rotation 18 of drive motor 2.

As shown in FIGS. 2 to 5, a manually operable hammer drill 1 of such kind includes a drive motor 2, a tool spindle 3, a rotary drive transmission 4, a hammer mechanism 5, a hammer mechanism transmission 6 and a switching device 7. During operation, tool spindle 3 rotates about an axis of rotation 8 and serves to drive a tool particularly a hammer drill tool, not shown here, in rotary manner. Rotary drive transmission 4 couples drive motor 2 with tool spindle 3. Hammer mechanism 5 serves to drive the tool with percussive action. In the example, hammer mechanism 2 is operated pneumatically. Hammer mechanism transmission 6 couples drive motor 2 with hammer mechanism 5. Hammer mechanism 5 may be activated and deactivated via switching device 7. When hammer mechanism 5 is deactivated, hammer drill 1 may be used as a simple drill, so that the respective tool is then driven only in rotary manner, without hammer action.

Switching device 7 is equipped with a clutch 9 that is integrated in the force path 10 of hammer mechanism transmission 6—indicated by a broken line. Clutch 9 has an actuating stroke 11, indicated by a double-headed arrow, which extends perpendicularly to axis of rotation 8 of tool spindle 3. Actuating stroke 11 is characterized by the direction of movement of a coupling member 12, in which coupling member 12 is displaceable in order to advance and withdraw clutch 9.

In the embodiments shown here, coupling member 12 is a clutch ring, which will also be designated with the number 12 in the following. This clutch ring 12 is arranged inside hammer mechanism transmission 6. In force path 10, clutch ring 12 is located between a driving gearwheel 13 of hammer mechanism transmission 6 on its input side and a crank drive wheel 14 of hammer mechanism transmission 6 on its output side. Driving gearwheel 13 engages with a drive sprocket 15 of a drive shaft 16 of drive motor 2. Driving gearwheel 13 is supported so as to be rotatable about an axis of rotation 17, which in the example extends parallel with an axis of rotation 18 which in the example extends parallel of drive shaft 16 of drive motor 2. At the same time, driving gearwheel 13 is supported in rotatable manner on a static shaft 19. Crank drive wheel 14 is also supported so as to be rotatable about the axis of rotation 17 of driving gearwheel 13. In the example, crank drive wheel 14 is also supported rotatably on static shaft 19. When hammer mechanism 5 is activated, crank drive wheel 4 drives a connecting rod 20 of hammer mechanism 5, driving a piston 21 in oscillating manner for example, which piston is supported inside the hollow tool spindle 3 so as to be displaceable in linear manner.

Figure 7:
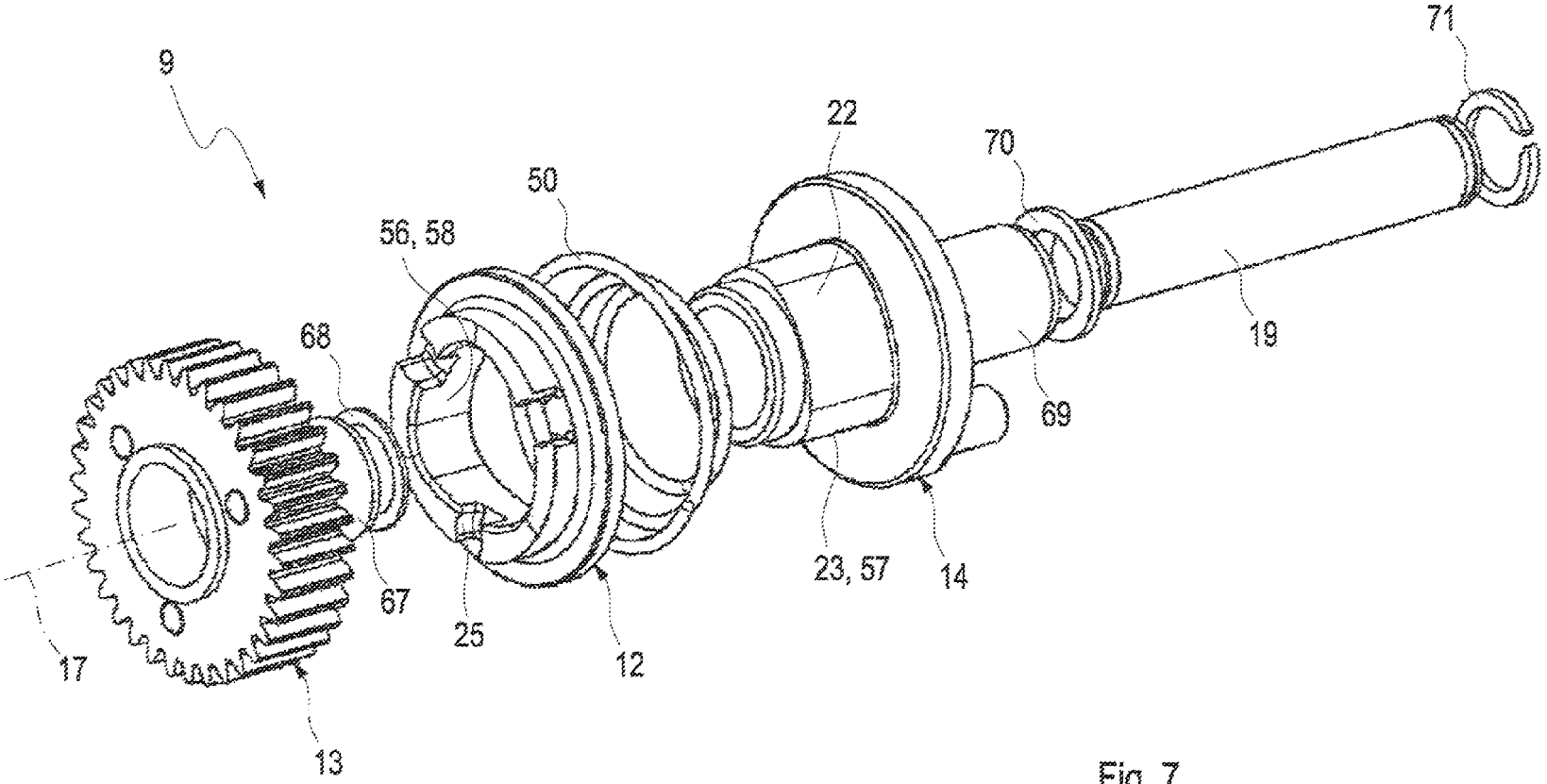
FIG. 7 is an exploded, perspective view in the area of a clutch in a different embodiment.

Clutch ring 12 is arranged on crank drive wheel 14 and coaxially with the axis of rotation 17 of driving gearwheel 13 in such manner that is axially displaceable on crank drive wheel 14 and at the same time coupled non-rotatably therewith. As illustrated in exemplary manner in the embodiment of FIGS. 2 to 5, this capability of axial movement simultaneously with rotational immobilisation as achieved with an axial gear arrangement. In the embodiments shows here, crank drive wheel 14 has an axial section 22 that extends coaxially with axis of rotation 17 of driving gearwheel 13. This axial section 22 has a slaving contour 23 extending axially on its radial periphery that cooperates with a complementary slaving contour 56 on clutch ring 12. Consequently, the two cooperating slaving contours 23, 56 allow an arrangement in which clutch ring 12 is able to move axially along the cylindrical section 22 of crank drive wheel 14 but is immobilised in the radial direction. For example, as shown in FIGS. 2 to 5, the one slaving contour 23 has at least one axial ridge, while the other slaving contour 56 has at least one axially extending seating groove mating therewith. Alternatively, FIG. 7 shows an embodiment in which crank drive wheel 4 has a polygonal profile 57 on the exterior thereof, while clutch ring 12 has a interior polygonal profile 58 that is conformed to mate with exterior polygonal profile 57. When they are engaged with one another, these two cooperating polygonal profiles 57, 58 create a coupling between clutch ring 12 and crank drive wheel 14 that is radially fixed and axially movable.

In the embodiment shown in FIG. 7, exterior slaving contour 23 on crank drive wheel 14 is constructed as an externally located polygonal profile, while interior slaving contour 56 on clutch ring 12 is constructed as in internally located polygonal profile 58 in complementary manner thereto.

Besides crank drive wheel 14 and clutch ring 12, the section of clutch 9 illustrated in FIG. 7 is also shown to be fitted with driving gearwheel 13, a needle bearing 67 for supporting driving gearwheel 13 on shaft 19, a disc 68, a thrust spring 50 for biasing clutch ring 12 axially against driving gearwheel 13, a needle bearing 69 to support crank drive wheel 14 on shaft 19, a disc 70, and a retaining ring 71.

The axial side of driving gearwheel 13 facing crank drive wheel 14 is furnished with a slaving contour 24. The axial side of clutch ring 12 facing driving gearwheel 13 is also furnished with a slaving contour 25 that is conformed in complementary manner to the slaving contour 24 on driving gearwheel 13. When clutch ring 12, and thus also clutch 9, is in the advanced state, the two slaving contours 24, 25 cooperate to transmit torque, and when clutch ring 12 is withdrawn they are no longer engaged with one another and no torque is transmitted. The one slaving contour 24 for example may be equipped with at least one pin, as shown in FIG. 2, while the other slaving contour 25 have be furnished with at least one matching recess to accommodate the pin, in which the pin may engage axially.

Figure 3:
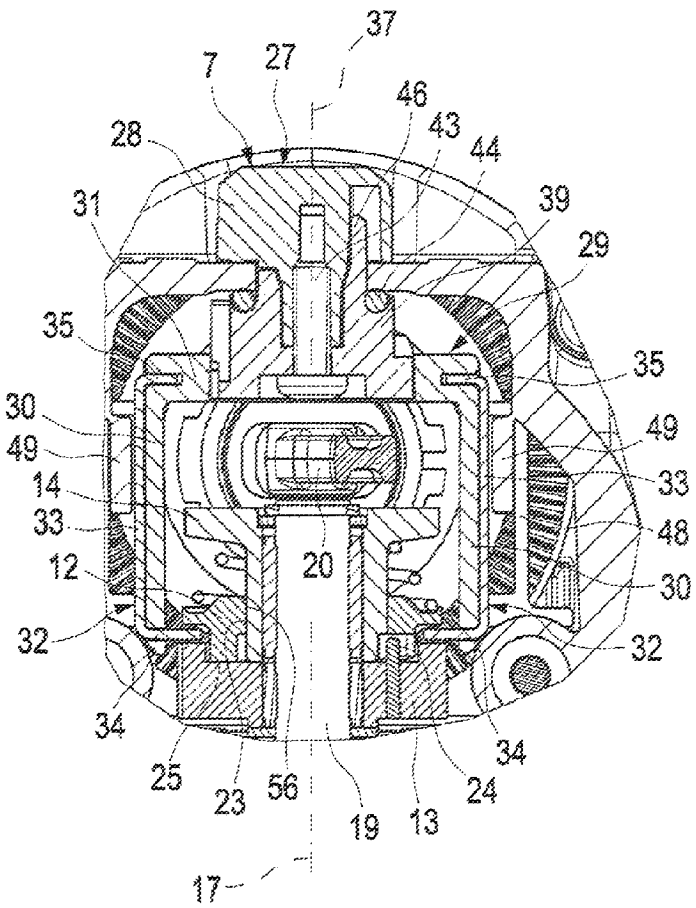
FIG. 3 is a cross section through the hammer drill along sectional lines III in FIG. 2.
Figure 2:
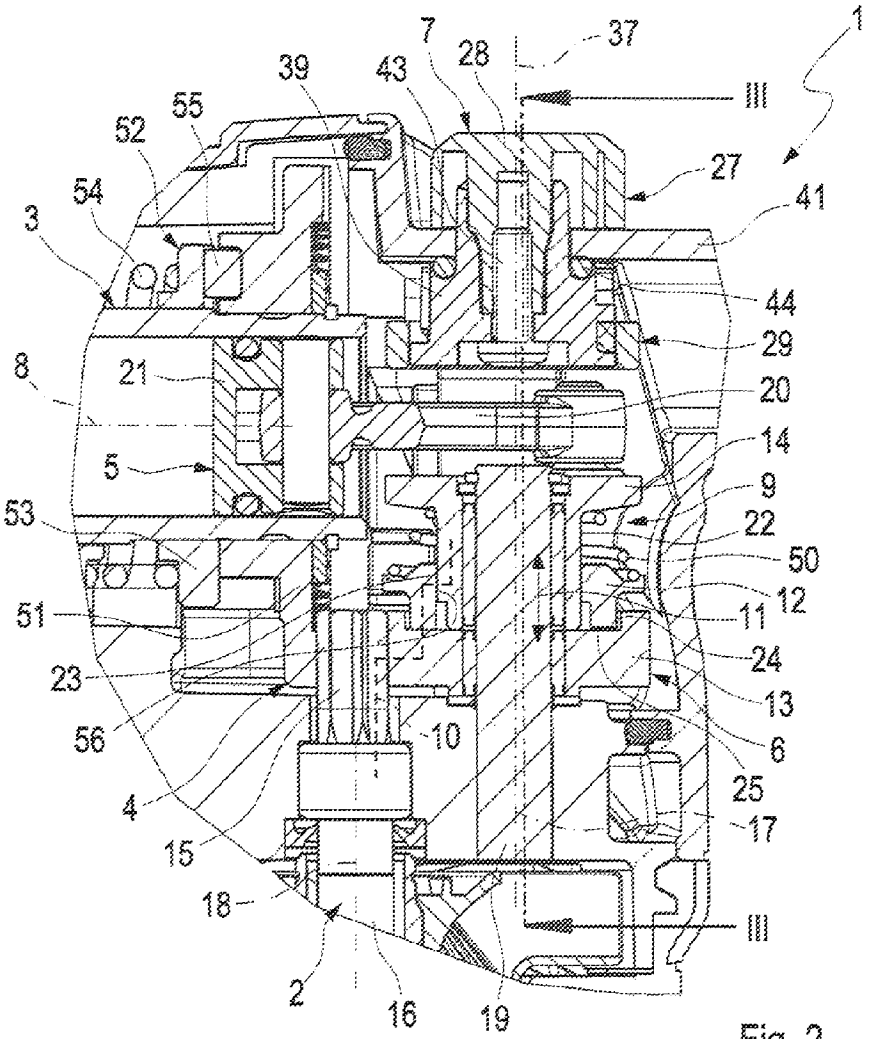
FIG. 2 is a lengthwise section through an area of an actuating device marked II on the hammer drill of FIG. 1 with the hammer mechanism activated.

In FIGS. 2 and 3, clutch ring 12, and thus also clutch 9, is shown in the advanced position. Axial slaving contours 24, 25 of driving gearwheel 13 and clutch ring 12 are engaged with one another and complete force path 10 for transmitting torque from driving gearwheel 13 to crank drive wheel 14 via clutch ring 12. Thus when clutch 9 and together with clutch ring 12 is in the advanced position, hammer mechanism 5 is activated.

Figure 5:
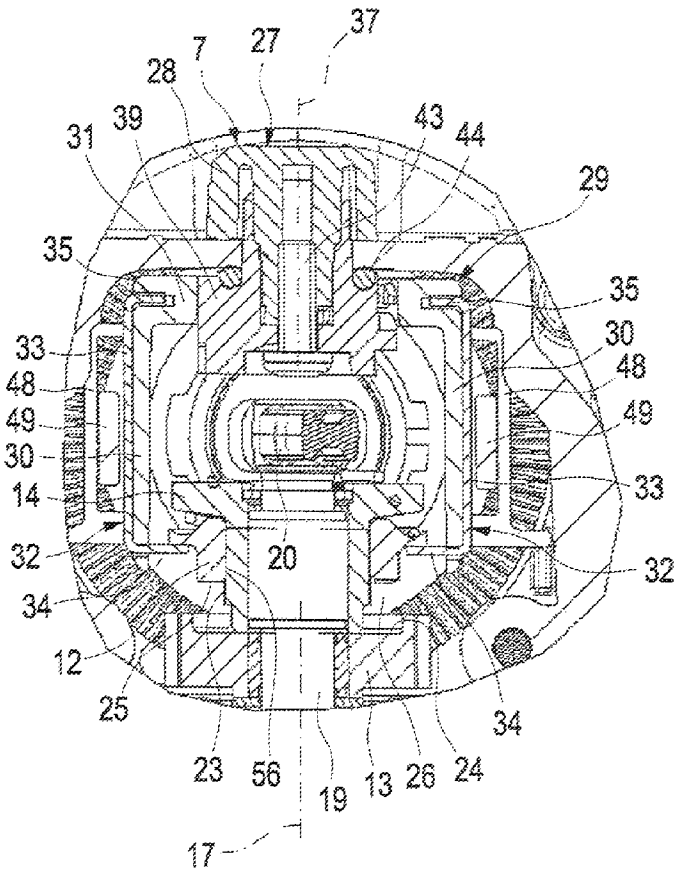
FIG. 5 is a cross section through the hammer drill along sectional lines V in FIG. 4.
Figure 4:
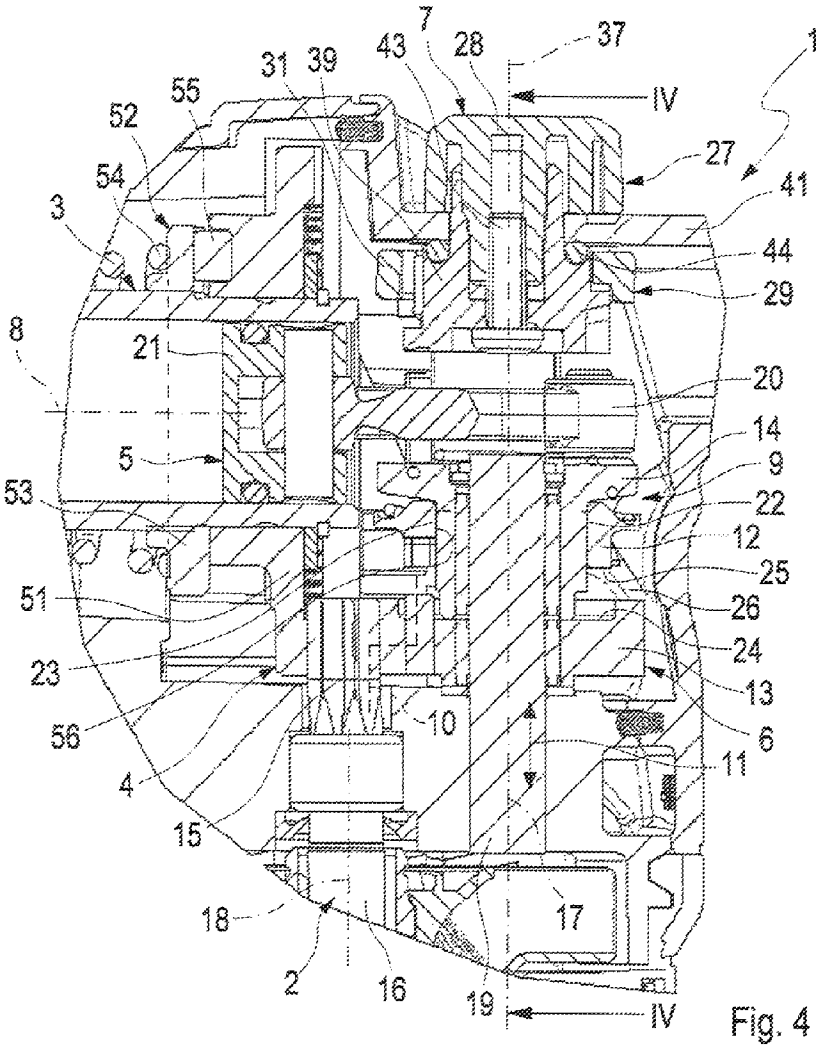
FIG. 4 is a lengthwise section as in FIG. 2, but with the hammer mechanism deactivated.

In contrast to this, FIGS. 4 and 5 shows hammer mechanism 5 in the deactivated state. For this, clutch ring 12, and thus also clutch 9, is withdrawn so that slaving contours 24, 25 on driving gearwheel 13 and clutch ring 12, which have been designed to engage with another, are disengaged. FIGS. 4 and 5 show an axial separation 26 that prevents engagement and the transmission of any torque In this way, force path 10 is interrupted.

In the embodiments shown here, switching device 7 is equipped with an actuation device 27. This includes a manually operable actuating element 28 and a stroke element 29. Actuation device 27 couples clutch ring 12 with actuating element 28 so that clutch 9, and thus also clutch ring 12, may be advanced and withdrawn. In this context, the movement is created via stroke element 29. The stroke element is furnished with at least one arm section 30, which extends parallel to the axis of rotation 17 of driving gearwheel 13. In the examples presented here, stroke element 29 is furnished with two such arm sections 30, which are arranged diametrically opposite one another with respect to axis of rotation 17 of driving gearwheel 13. In other words, the two arm sections 30 are disposed at an angle of 180° to one another. This means that they are arranged on opposite sides of axis of rotation 17 of driving gearwheel 13. Respective arm section 30 is coupled with clutch ring 12 in such manner that when stroke element 29 is moved away from driving gearwheel 13 in a stroke path extending parallel to axis of rotation 17 of driving gearwheel 13, it picks up and withdraws clutch ring 12, and advances the clutch ring when it moves in the opposite direction.

Figure 6:
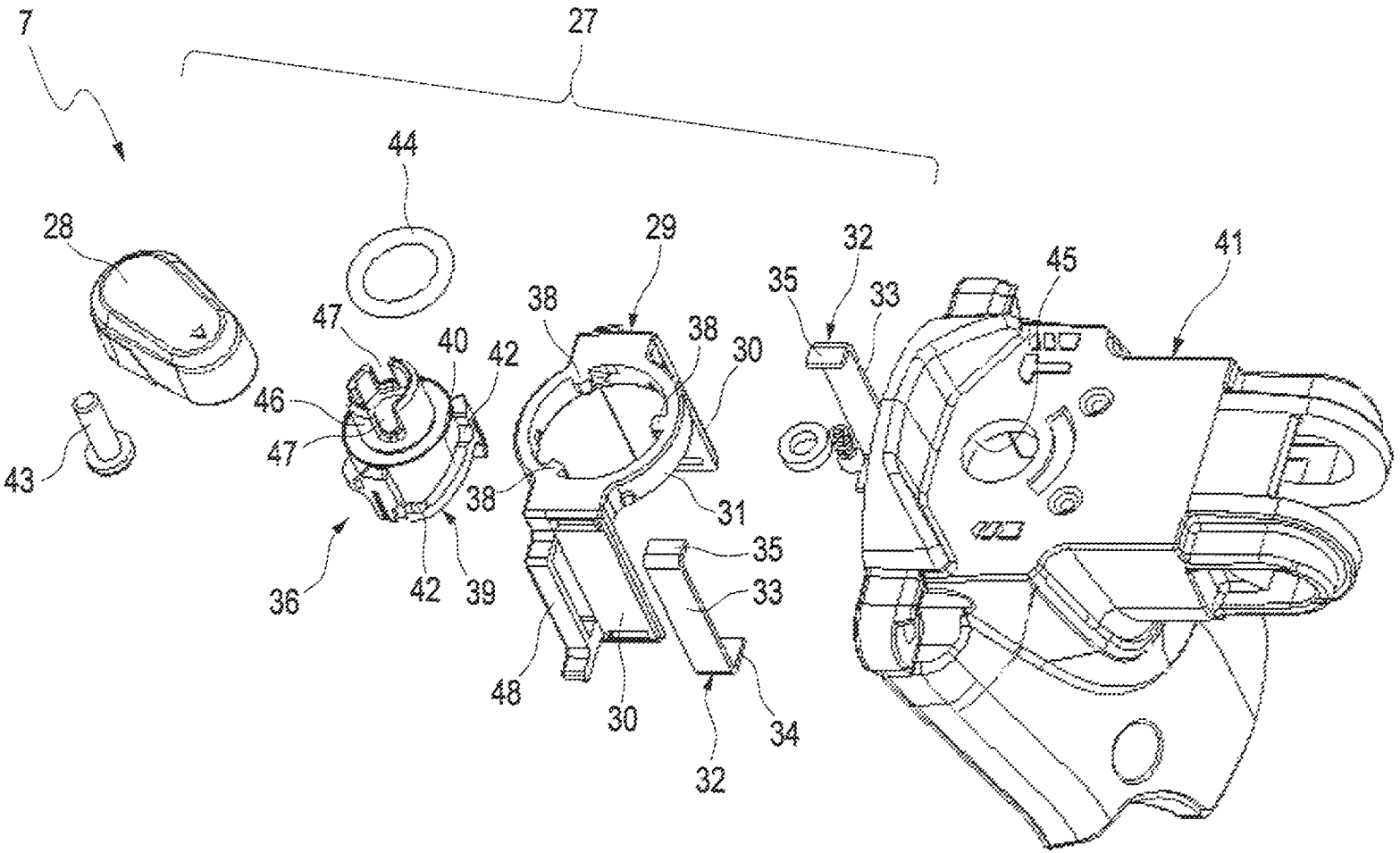
FIG. 6 is an exploded, perspective view of an actuating device and a section of housing.

Stroke element 29 includes an annular section 31, from which the two arm sections 30 project, and which is aligned coaxially with axis of rotation 17 of driving gearwheel 13 and is located on a side of crank drive wheel 14 facing away from driving gearwheel 13. Arm sections 30 extend over the sides of crank drive wheel 14 and terminate close to clutch ring 12. In the example of FIGS. 3, 5 and 6, arm sections 30 are reinforced with bracing elements 32. Bracing elements 32 are essentially U-shaped and engage behind clutch ring 12. In particular, a U-base 33 of the respective bracing clip 32 lies flush against the rest of the body of the respective arm section 30. A leg of the U-shape 34 proximal to clutch ring 12 serves to clasp or engage behind clutch ring 12. A leg of the U-shape 35 distal to clutch ring 12 engages in a corresponding recess in annular section 31. Because it is braced by these clips 32, stroke element 29 may be injection moulded from plastic, while the bracing clips 32 themselves are made from metal, for example.

Actuating device 27 may be equipped with a stroke drive 36, as shown particularly in FIG. 6. This stroke drive may convert the manual operation of actuating element 28 into a stroke displacement of stroke element 29. In this context, stroke drive 36 is designed in such manner that it converts a rotary operation of actuating element 28 about an axis of rotation 37 into a stroke displacement of stroke element 29 in a direction parallel to this axis of rotation 37. In the preferred examples shown here, the axis of rotation 37 of actuating element 28 is coincident with the axis of rotation 17 of driving gearwheel 13, with the result that the stroke of stroke element 29 also extends parallel to axis of rotation 17. In this context, stroke drive 36 cooperates with annular section 31 of stroke element 29. For this purpose, annular section 31 may be furnished with at least one sliding member 38 protruding radially inwards, as illustrated in the embodiment shown here. In the example, three such sliding members 38 are provided, and are arranged at equal distances from each other about the circumference.

Stroke drive 36 is equipped with a bushing 39, which is rotatable coaxially with annular section 31. This bushing 39 is furnished radially outwardly with at least one shoulder 40, which rises axially in the periopheral direction of bushing 39. In the example, one such shoulder 40 is provided on each sliding member 38. Accordingly, bushing 39 has three shoulders 40 arranged about the circumference thereof. Each shoulder cooperates with one of the sliding members 38 in such manner that a rotary displacement of bushing 39 is converted into a stroke displacement of stroke element 29. Stroke element 29 arranged so as to be rotationally immovable but stroke-displaceable in housing 41 or a housing compartment of hammer drill 1. When bushing 39 is rotated, sliding members 38 slide along the respective shoulder 40, causing a stroke displacement of stroke element 29. In order to protect the respective upper or lower end position of stroke element 29, the lower and/or upper end(s) of shoulders 40 may be equipped with a detent stage 42. When it reaches the respective end position, sliding member 38 engages with the associated detent stage 42 creating a haptically perceptible non-positive locking safety catch in the manner of a pressure point, and making it difficult or impossible for bushing 39 and thus also actuating element 28 to move on its own.

Actuating element 28 is connected in non-rotating manner with bushing 39. For example, a screw 43 is screwed from the inside through bushing 29 and into actuating element 28 for this purpose. Actuating element 28 is arranged on an external side of housing 41 of hammer drill 1. On the other hand, bushing 39 is arranged on an internal side of housing 41. A gasket 44 may be located between bushing 39 and housing 41 to seal housing 41 in the area of a passthrough 45. This gasket 44 is designed in such manner that it permits rotary movements of bushing 39. Bushing 39 may be furnished with a cylindrical extension 46 that protrudes through passthrough 45 from the inside to the outside of housing 41 to create a rotationally locked connection between actuating element 28 and bushing 39. Extension 46 has a plurality of radial gaps 47 that are engaged in positive locking manner by sections of actuating element 28. This is illustrated clearly in FIG. 2, for example.

Stroke element 29 is furnished with outwardly projecting longitudinal guides 48 in the area of its arm sections 30, in which guide elements 49 of housing 41 engage as shown in FIGS. 3 and 5. In this way, a linear guide is created for stroke element 29, helping to ensure precise stroke displacement.

As shown in FIGS. 2 to 5 and 7, a thrust spring 50 may also be provided to force clutch ring 12 axially against driving gearwheel 13. Thrust spring 50 thus forces clutch ring 12 into the advanced position.

Rotary drive transmission 4 may expediently be a crown wheel 51 with axial spur gearing, and which also engages with drive sprocket 15 of drive motor 2 on the side diametrically opposite driving gearwheel 13. Crown wheel 51 is supported rotatably on tool spindle 3 and cooperates with a torque-dependent coupling 52. Torque-dependent coupling 52 includes a drive ring 53 that is arranged in rotationally fixed and axially displaceable manner on tool spindle 3 and is forced against crown wheel 51 with the aid of biasing spring 54. Coupling bodies 55 enable ring 53 and thus also tool spindle 3 to be driven. If the torque that is transmitted to tool spindle 3 from crown wheel 51 exceeds a predefined limit value, coupling bodies 55 displace ring 53 against the biasing force of spring 54 and crown wheel 51 is able to continue rotating when tool spindle 3 is stationary.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A power tool comprising:

a drive motor (2);

a tool spindle (3) for driving a tool in rotary manner;

a rotary drive transmission (4) for coupling the drive motor (2) with the tool spindle (3);

a hammer mechanism (5) for driving the tool in percussive manner;

a hammering mechanism transmission (6) for coupling the drive motor (2) with the hammering mechanism (5); and a switching device (7) for activating and deactivating the hammering mechanism (5), wherein the switching device (7) has a clutch (9) that is integrated in a force path (10) of the hammer mechanism transmission (6) and an actuation stroke (11) for advancing and withdrawing the clutch (9), wherein the actuation stroke (11) extends perpendicularly to the axis of rotation (8) of the tool spindle (3) parallel to an axis of rotation (37) of an actuating element (28) of the switching device (7) that is rotated manually for advancing and withdrawing the clutch (9), wherein the switching device (7) includes an actuating device (27) that has a stroke drive (36) that converts a manually applied rotary movement of the actuating element (28) into a stroke displacement of a stroke element (29), the stroke element (29) cooperating with an annular section (31) that has at least one radially inwardly protruding sliding member (38) and the stroke drive (36) has a bushing (39) that is rotatable coaxially with the annular section (31) and which has at least one radially external shoulder (40) rising axially in the circumferential direction, which cooperates with the sliding member (38) to convert a rotary movement of the bushing (39) into a stroke displacement of the stroke element (29).

2. The power tool as recited in claim 1, wherein the hammer mechanism transmission (6) has an input-side driving gearwheel (13) that is mounted rotatably about an axis of rotation (17), the hammer mechanism transmission (6) has an output-side crank drive wheel (14) that is mounted rotatably about the axis of rotation (17) of the driving gearwheel (13) and drives a connecting rod (20) of the hammer mechanism (5) when the hammer mechanism (5) is activated, and that the clutch (9) has a clutch ring (12) in the hammer mechanism transmission (6) that is arranged on the crank drive wheel (14) coaxially with the axis of rotation (17) of the driving gearwheel (13) so to be axially displaceable and non-rotating with respect to the crank drive wheel (14).

3. The power tool as recited in claim 2, wherein the crank drive wheel (14) has a slaving contour (23) radially outwardly on an axial section (22) arranged coaxially with the axis of rotation (17) of the driving gearwheel (13) which cooperates with a mating interior slaving contour (56) on the clutch ring (12) so that the clutch ring (12) is arranged in rotationally fixed and axially displaceable manner on the axial section (22) of the crank drive wheel (14).

4. The power tool as recited in claim 2, wherein the crank drive wheel (14) has an externally located polygonal profile (57), whereas the clutch ring (12) has an internally located polygonal profile (58) corresponding therewith, wherein the clutch ring (12) is arranged in rotationally fixed and axially displaceable manner on the crank drive wheel (14) via these polygonal profiles (57, 58).

5. The power tool as recited in claim 2, wherein the driving gearwheel (13) has a slaving contour (24) on the axial side facing the crank drive wheel (14), and the clutch ring (12) has a slaving contour (25) corresponding to the slaving contour (24) of the driving gearwheel (13) on the axial side facing the driving gearwheel (13), which cooperates with the slaving contour (24) of the driving gearwheel (13) to transmit torque when the clutch ring (12) is in the advanced position, and is axially separated therefrom when the clutch ring is in the withdrawn position.

6. The power tool as recited in claim 2, wherein the actuating device (27) advances and withdraws the clutch (9), which couples the manually operable actuating element (28) with a stroke-displaceable coupling member (12), wherein the actuating device (27) has the stroke element (29) that is coupled with the clutch ring (12) via at least one arm section (30) extending parallel to the axis of rotation (17) of the driving gearwheel (13), so that a stroke displacement of the stroke element (29) away from the driving gearwheel (13) and parallel to the axis of rotation (17) of the driving gearwheel (13) also moves the clutch ring (12), withdrawing it.

7. The power tool as recited in claim 6, wherein the actuating device (27) has the stroke drive (36) that converts a manually applied rotary movement of the actuating element (28) into a stroke displacement of the stroke element (29), wherein the stroke drive (36) cooperates with the annular section (31) of the stroke element (29) that is axially parallel with the axis of rotation (17) of the driving gearwheel (13) and from which the respective arm section (30) extends.

8. The power tool as recited in claim 7, wherein the annular section (31) is arranged coaxially with the axis of rotation (17) of the driving gearwheel (13).

9. The power tool as recited in claim 2, including a thrust spring (50) is provided that biases the clutch ring (12) axially against the driving gearwheel (13).

10. A power tool comprising:

a drive motor (2);

a tool spindle (3) for driving a tool in rotary manner;

a rotary drive transmission (4) for coupling the drive motor (2) with the tool spindle (3);

a hammer mechanism (5) for driving the tool in percussive manner;

a hammering mechanism transmission (6) for coupling the drive motor (2) with the hammering mechanism (5); and a switching device (7) for activating and deactivating the hammering mechanism (5), wherein the switching device (7) has a clutch (9) that is integrated in a force path (10) of the hammer mechanism transmission (6) and an actuation stroke (11) for advancing and withdrawing the clutch (9), wherein the actuation stroke (11) extends perpendicular to the axis of rotation (8) of the tool spindle (3) parallel to an axis of rotation (37) of an actuating element (28) of the switching device (7) that is rotated manually for advancing and withdrawing the clutch (9);

wherein the hammer mechanism transmission (6) has an input-side driving gearwheel (13) that is mounted rotatably about an axis of rotation (17), the hammer mechanism transmission (6) has an output-side crank drive wheel (14) that is mounted rotatably about the axis of rotation (17) of the driving gearwheel (13) and drives a connecting rod (20) of the hammer mechanism (5) when the hammer mechanism (5) is activated, and that the clutch (9) has a clutch ring (12) in the hammer mechanism transmission (6) that is arranged on the crank drive wheel (14) coaxially with the axis of rotation (17) of the driving gearwheel (13) so to be axially displaceable and non-rotating with respect to the crank drive wheel (14), the switching device (7) has an actuating device (27) for advancing and withdrawing the clutch (9), which couples the manually operable actuating element (28) with a stroke-displaceable coupling member (12), wherein the actuating device (27) has a stroke element (29) that is coupled with the clutch ring (12) via at least one arm section (30) extending parallel to the axis of rotation (17) of the driving gearwheel (13), so that a stroke displacement of the stroke element (29) away from the driving gearwheel (13) and parallel to the axis of rotation (17) of the driving gearwheel (13) also moves the clutch ring (12), withdrawing it, the actuating device (27) has a stroke drive (36) that converts a manually applied rotary movement of the actuating element (28) into a stroke displacement of the stroke element (29), wherein the stroke drive (36) cooperates with an annular section (31) of the stroke element (29) that is axially parallel with the axis of rotation (17) of the driving gearwheel (13) and from which the respective arm section (30) extends, and the annular section (31) has at least one radially inwardly protruding sliding member (38), wherein the stroke drive (36) has a bushing (39) that is rotatable coaxially with the annular section (31) and which has at least one radially external shoulder (40) rising axially in the circumferential direction, which cooperates with the sliding member (38) to convert a rotary movement of the bushing (39) into a stroke displacement of the stroke element (29), wherein multiple sliding members (38) and the same number of shoulders (40) are provided, and are arranged about the circumference, wherein the lower and upper end of the respective shoulder (40) has a detent stage (42) in which the respective sliding member (38) engages when the respective end position is reached.

11. The power tool as recited in claim 10, wherein the actuating element (28) is connected in non-rotating manner to the bushing (39), wherein the actuating element (28) is arranged on an exterior side of a housing (41) of the power tool (1), whereas the bushing (39) is arranged inside the housing (41).

* * * * *

UNITED STATES PATENT AND TRADEMARK OFFICE

CERTIFICATE OF CORRECTION

PATENT NO. : 8,622,148 B2
APPLICATION NO. : 13/009176
DATED : January 7, 2014
INVENTOR(S) : Eisenhardt It is certified that error appears in the above-identified patent and that said Letters Patent is hereby corrected as shown below:

IN THE CLAIMS:

Claim 1, column 7, line 53: “the axis” should read as --an axis--

Claim 10, column 9, line 16: “the axis” should read as --an axis--

Signed and Sealed this
Twentieth Day of May, 2014

Michelle K. Lee

Michelle K. Lee
*Deputy Director of the United States Patent and Trademark Office*